United States Patent [19]

Miloslaus

[11] Patent Number: 5,009,259

[45] Date of Patent: Apr. 23, 1991

[54] ROLLER BLIND SUPPORT

[75] Inventor: Ludwig Miloslaus, Trittau, Fed. Rep. of Germany

[73] Assignee: Aerolux Produktions- und Handelsgesellschaft mbH, Norderstedt, Fed. Rep. of Germany

[21] Appl. No.: 399,494

[22] PCT Filed: Feb. 25, 1988

[86] PCT No.: PCT/EP88/00139

§ 371 Date: Aug. 24, 1989

§ 102(e) Date: Aug. 24, 1989

[87] PCT Pub. No.: WO88/06672

PCT Pub. Date: Sep. 7, 1988

[30] Foreign Application Priority Data

Feb. 28, 1987 [DE] Fed. Rep. of Germany ... 8703112[U]

[51] Int. Cl.[5] ..... E06B 9/17

[52] U.S. Cl. ..... 160/323.1; 160/324

[58] Field of Search ..... 160/323.1, 238, 324, 160/321

[56] References Cited

U.S. PATENT DOCUMENTS 1,379,663 5/1921 Tomasulo .
2,487,648 11/1949 Green .
3,968,826 7/1976 Zilver ..... 160/323.1
4,751,953 6/1988 Appel et al. ..... 160/323.1 X

FOREIGN PATENT DOCUMENTS 2617502 11/1976 Fed. Rep. of Germany ... 160/323.1
3211506 10/1983 Fed. Rep. of Germany .
2184019 12/1973 France .
8877 10/1911 United Kingdom .

*Primary Examiner*—Blair M. Johnson
*Attorney, Agent, or Firm*—Chilton, Alix & Van Kirk

[57] ABSTRACT

First and second substantially identical fixture parts (1) are provided for attachment to the room structure in opposed, spaced apart relation before the roller blind is installed. Each fixture part has a fixed collar (9) projecting coaxially toward the fixed collar of the other fixture part. Each collar has a passage aperture (10) extending radially therethrough. A first bearing part (2) is rotatably disposed on the first fixture part for selectively securing the bearing part in a particular rotational position. The bearing part has a bearing shell (13) in coaxial, overlapped relation to the collar for rotatably receiving the support pin (38) of the roller blind, and an insertion aperture (14) which extends radially through the shell. When the bearing part is in a rotationally open position, the insertion aperture is aligned with the passage aperture in the collar whereby the support pin can be displaced radially from outside the bearing part to a final positon on the axis in the shell. The bearing part is then rotated to close the passage aperture so that the pin is trapped on the axis within the shell and collar.

12 Claims, 1 Drawing Sheet

ROLLER BLIND SUPPORT

The invention relates to a roller blind support as claimed in the preamble of claim 1.

The roller blind supports provided at both ends of a roller blind are fixed on the wall or the ceiling prior to fitting of the roller blind. It must then be possible for the bearing pins provided on the ends of the roller blind to be inserted into the bearing parts provided for them. While the bearing pin to be inserted first can be pushed into a bore approximately in the lengthwise direction of said bore provided to accommodate it, a bearing shell for the accommodation of the other pin must be open at the side for the insertion of the pin, in order to form an insertion path for the pin. The roller blind support has a fitting position which differs relative to the vertical direction when it is fitted on a vertical wall or a horizontal ceiling. On the other hand, the bearing part must always have the same predetermined fitted position relative to the vertical direction. This applies not only to the bearing part which for the accommodation of a roller blind pin contains a bearing shell and an insertion aperture which opens, for example, from the top into the bearing shell, but also applies when the bearing part accommodates a drive part for the roller blind and has apertures out of which drive or control elements are conveyed downwards, for example a drag chain.

A roller blind support whose bearing part has a bearing shell for a roller blind pin and can be connected to the fixing part in four different angular positions is known (DE-A 35 26 160), the angular position being selected according to the fitting position of the fixing part (on a wall or on a ceiling, to the left or right of the roller blind). Since roller blinds are generally supplied ready for fitting from the factory, the adjustment of the bearing part on the fixing part must be prepared in the workshop. This is organizationally time-consuming, because each order requires individual workshop processing. It would be simpler if the adjustment could be left to the fitter installing the roller blind. However, in the case of the known devices this is not advisable, because they cannot be adjusted simply enough, and therefore, when the adjustment is carried out by amateurs, errors occur which are then mostly wrongly blamed on the manufacturer.

A roller blind is also known in which a metal angle guide to be fitted on the wall has two fixing apertures at equal distances from the fixing flange, one of which is cross-shaped to accommodate the non-rotatable end of a roller blind, while the other is for the accommodation of a bearing part for the rotatable end of the roller blind (DE-A 23 22 738=FR-A 2184019). Since the bearing part does not have a radial insertion aperture for the shaft to be carried, the bearing part and the fixing aperture provided for its accommodation are designed in such a way that in a first rotated position the bearing part with the shaft therein can be inserted into the fixing aperture and in another rotated position can be secured in the fixing aperture, by locking means.

A rod support comprising a metal angle piece to be fixed on the wall and an accommodation part for the end of the rod is known for holding curtain rods (GB-A-8877/1911). In order to be able to place the accommodation part in a desired accommodation direction, it is rotatably fixed on the metal angle piece. This device is not suitable for mounting roller blinds.

In order to secure a roller blind pin which is rectangular in cross-section in the mounting support of a fixing part, it is also known (U.S. Pat. No. 2,487,648) to mount the mounting support round an annular hasp which is interrupted at one point. For the insertion of the pin the hasp is adjusted in such a way that its interruption is flush with the insertion aperture of the mounting support. It is then turned in such a way that it closes the insertion aperture.

In yet another roller blind support (U.S. Pat. No. 1,379,663) the fixing part has a mounting support for the roller blind pin which has an insertion aperture at the top. In order to prevent the roller blind from running against the fixing part, provision is also made for a cap whose central aperture takes the end of the roller blind shaft, and whose collar can be pushed onto appropriate catch elements of the fixing part after insertion of the roller blind pin in the mounting support. So long as the cap is fixed on the fixing part, the roller blind pin cannot leave the mounting support, because the central aperture of the cap limits the lateral movement of the roller blind shaft. This known roller blind support is not suitable for different directions of installation, because a proper mounting of the roller blind pin is ensured only when the insertion aperture is at the top; for the cap cannot take on any bearing function.

The object of the invention is therefore to produce a roller blind support of the type mentioned in the preamble of claim 1, which requires no individual preparation in the manufacturer's workshop for fitting in different directions, and which can be adjusted easily by unskilled people.

The solution according to the invention is found in the characterizing features of claim 1.

Without great expenditure of time and mental effort, the fitter can see on the spot how the blind support has to be adjusted, and can make this adjustment during or after fitting by simply turning the bearing part relative to the fixing part. Any known fixing means can in principle be used for fixing in the rotation position. Particular preference is given to a friction fixing mechanism, which is characterized in that between the parts which are rotatable relative to each other such great friction exists that it cannot be overcome by the operational forces, and to a catch fixing mechanism which is based on mating catch elements on the parts which are rotatable relative to each other, and which are disengaged when a force threshold is overcome.

In the usual fitting situation, the collar blocks the insertion path, so that the roller blind pin cannot slip out of the bearing shell. For fitting or removal the bearing part is placed in the rotation position in which the insertion path of the bearing part lies in the same direction as the passage aperture of the collar. The passage aperture then lies in the insertion path, so that the latter is open. When the roller blind pin is introduced into the bearing shell and lies inside the collar, the bearing part is rotated relative to the fixing part in such a way that the insertion path is directed, for example, upwards. A closed part of the collar then lies in the insertion path, so that the pin cannot slide out. The different settings can easily be identified for the user by suitable markings on the parts which are rotatable relative to each other.

Since according to the invention the pin provided on the fixing part at the drive side for the accommodation of a drag spring is designed in such a way that it serves to form the collar just mentioned, the same fixing part can be used for both sides, the collar serving, on the one hand, to secure the roller blind pin in the bearing shell and, on the other, to accommodate the drag spring. By comparison, different fixing parts hitherto had to be provided for the roller blind supports on the drive side and on the pin side.

Various solutions known to the expert are available for the rotary connection between fixing part and bearing part. The preferred one according to the invention is an arrangement in which the bearing part has a case whose edge grips tightly over a shoulder of the fixing part, and in which the edge and the shoulder engage with each other with projecting and recessed connecting elements, of which at least the element provided on one of the two parts is annular in shape. For example, the shoulder on the fixing part can have a circular groove in which several projections disposed on the inside of the case edge engage. Instead of individual projections, the case edge can also have a circular inward-projecting edge which engages on the entire periphery or on a considerable part thereof in the groove. In this case, the case is expediently made elastic, so that the two parts can be snapped elastically into each other. If the material is not sufficiently elastic, its elasticity can be increased by, for example, making slits in the case.

The drive part generally has a coupling bore of predetermined cross-sectional shape for non-rotatable accommodation of a roller blind coupling pin, and the cross-sectional shape can vary depending on the make of the blind. In order to ensure that the same blind support can be used with different makes of blinds, provision is made according to the invention for the coupling bore to be provided in an interchangeable adapter which is non-rotatably connectable to the drive part.

The invention is explained in greater detail below with reference to the drawing, which illustrates preferred examples of embodiments. In it:

Figure 1:
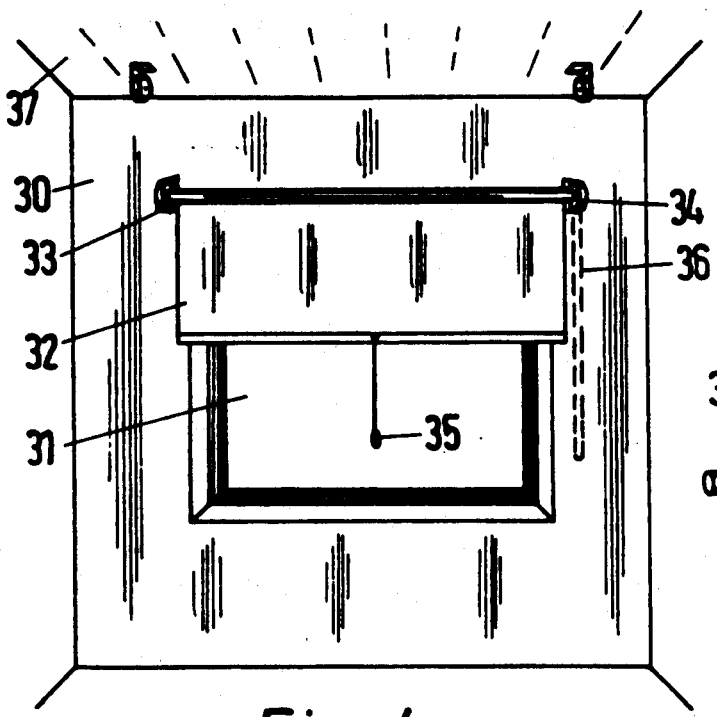
FIG. 1 shows the view of a fitted roller blind arrangement.

According to FIG. 1, a room wall 30 in front of a window 31 is fitted with a roller blind 32 by means of a left roller blind support 33 and a right roller blind support 34. This can be a spring tension blind which is pulled down by means of a blind pull 35, or it can be a side draw roller blind whose roller blind support 34 contains drive elements which are driven by means of a draw chain 36. As can easily be seen, the position of the roller blind support relative to the vertical direction and to the roller blind 32 depends on whether the fitting is to be on a wall 30 or (as also shown in FIG. 1) on a ceiling 37, and also depends on which side of the roller blind the roller blind support is fitted.

Figure 2:
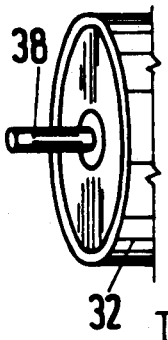
FIGS. 2 and 3 show the ends of a roller blind.
Figure 3:
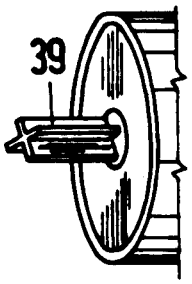

The bearing pins which project axially from the ends of roller blind 32 differ. FIG. 2 shows the cylindrical roller blind pin 38, which is to be disposed so that it can rotate, in a bearing shell of the roller blind support such as at 33, while FIG. 3 shows a coupling pin 39 which is to be connected non-rotatably such as to a drive part of the blind support 34 shown in FIG. 2 (as if it were located at the left side of the blind of FIG. 1).

Since the roller blind supports are fixed on the wall or ceiling before the roller blind is fitted, it is not possible to push the two bearing pins 38, 39 in their lengthwise direction into the appropriate accommodation aperture of the blind support. On the contrary, only one of the two pins, for example the pin 39, can be inserted approximately in the lengthwise direction of the appropriate accommodation aperture, while the second bearing pin has to reach the bearing shell accommodating it by swivelling of the roller blind about the first bearing pin in a lateral movement. The bearing support for the accommodation of this second roller blind pin is described below with reference to FIGS. 4 and 5 initially.

Figure 4:
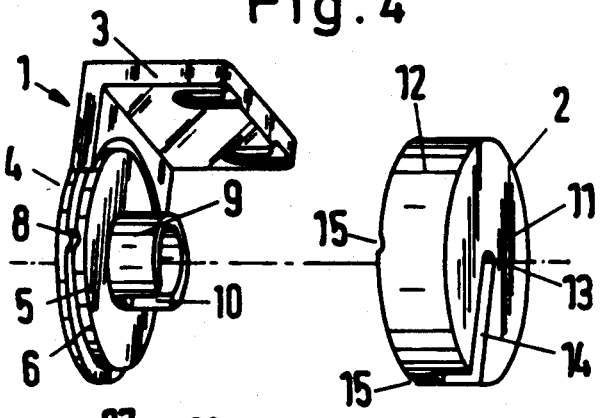
FIG. 4 shows a roller blind support for rotatable accommodation of the roller blind pin according to FIG. 2, taken apart.

The roller blind support according to FIG. 4 comprises a fixing part 1 and a bearing part 2. The fixing part 1 has a flange 3 for screwing on the wall or ceiling. It also has an arm 4 which is made disk or plate-shaped and at least partially round, and which has a convex shoulder 5 whose peripheral edge 6 contains a circular groove 7. The plate forming the arm also has a hollow cylindrical collar 9 containing a cutout 10 at one peripheral point.

The bearing part 2 comprises an end plate 11 and a generally cup-shaped case 12. Disposed in the center of the end plate 11 is the generally cylindrical bearing shell 13 from which a slit 14 goes out radially, said slit forming the insertion path through which a roller blind pin can be inserted from the side into the bearing shell 13.

The internal diameter of the edge of the case 12 is the same as the external diameter of the shoulder 5 and has a radially inward-projecting annular projection 16 which engages in the annular groove 7 of the fixing part when the blind is fitted. This produces a rotary bearing for the bearing part 2 of the fixing part 1, which permits rotation of the bearing part 2 relative to the fixing part.

Figure 5:
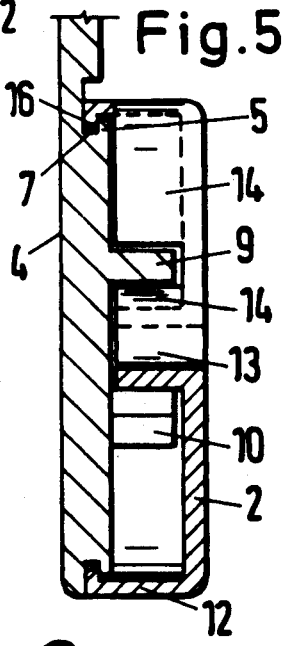
FIG. 5 shows a partial cross-section through the embodiment according to FIG. 4 when assembled, on a larger scale.

When the roller blind support has been fixed in the planned position, the roller blind pin 38 can be inserted into the slit 14 and the bearing shell 13, when the bearing part 2 is in the position relative to the fixing part 1 shown in FIG. 4, in which the position of the slit 14 corresponds to that of the cutout 10 in the collar 9. When the bearing pin lies in the bearing shell 13 and thus also inside the collar 9, the bearing part 2 is turned in such a way that the slit 14 is directed upwards, as shown in FIG. 5. The bearing shell 13 is then closed by the collar 9 at its opening side formed by the slit 14, and the bearing pin 38 is secured therein.

In order to ensure that this end position is maintained, the two parts 1 and 2 can be fixed so that they cannot rotate. This can be achieved in a simple manner through the parts 6, 7, 12, 16 forming the rotary bearing being adapted to each other in their dimensions in such a way that rotation can take place only against considerable frictional force which is greater than the rotation forces normally occurring during the operation of a roller blind. It is, however, preferable instead of or in addition to this to provide catch elements in the normally used rotation positions, by means of which the desired fixing takes place. These catch elements comprise interlocking elevations and recesses in the surfaces forming the rotary bearing. For example, according to FIG. 4, an elevation 8 is provided on the edge of the part 4 which adjoins the peripheral edge 6 of the shoulder 5, and the edge of the case 12 contains recesses 15 at appropriate points. The height of the elevation 8 is, on the one hand, selected in such a way that, when engaged with the recesses 15, it ensures the desired locking effect but in which, on the other hand, the parts forming the rotary bearing remain engaged when the elevation 8 is not in a recess 15.

Figure 6:
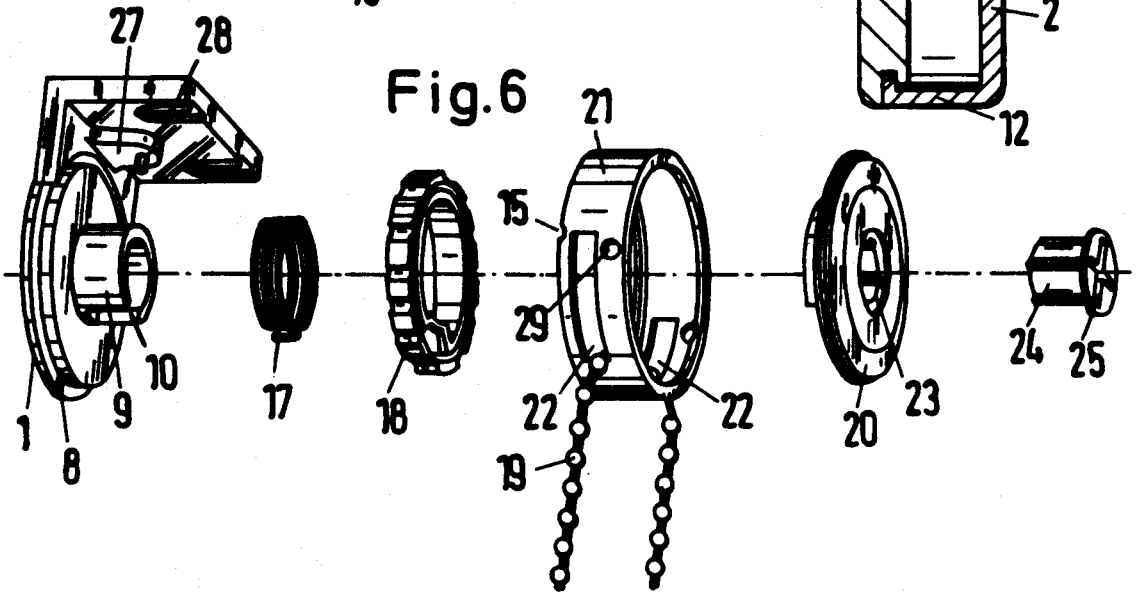
FIG. 6 shows a roller blind support on the drive side for a roller blind pin according to FIG. 3, taken apart.

The roller blind support on the drive side according to FIGS. 3 and 6 comprises a fixing part 1 which is the same as that of FIGS. 1 and 2. It also has known drive elements which comprise a drag spring 17, a chain wheel 18, a chain 19 and a coupling disc 20. The collar 9 here serves as a holder for the drag spring 17, which is placed in the traditional arrangement on the collar 9, the cutout 10 not being any hindrance. The chain wheel 18 and the chain 19 are of the usual type. The coupling disc 20 is also the same as that of the state of the art, unless otherwise described below.

The case 21 serves to hold and carry the drive elements. The coupling disc 20 is carried and retained therein. It contains apertures 22 for the passage of the chain 19. These apertures must be in line with the vertical direction in the fitted position. In order to make this possible, the case 21 is rotatably connected to the fixing part 1 in the same way as that explained with reference to FIGS. 4 and 5 above for the bearing part 2, and corresponding catch elements 8, 15 can also be provided.

The coupling disc 20 contains an adapter bore 23 for non-rotatable accommodation of an adapter 24 which has the coupling bore 25 for mating with a roller blind coupling pin 39 of the same cross-section. A multiplicity of such adapters 24 with differing cross-sectional shapes of the coupling bore 25 is provided for different makes of roller blind.

As a catch fixing mechanism, or in addition thereto, provision can be made on the drive side roller blind support for a locking device which ensures that the bearing ring (21) does not turn, even if (for example, with rough handling) unusually great turning forces act thereon. In the embodiment according to FIG. 6 this locking device is made up of a locking projection in the form of a pin 28 which is subsequently insertable into a bore in a lug 27 of the fixing part 1 and bores 29 which are provided at a suitable point in the case 21 and several of which are provided on the periphery in accordance with the adjustment possibilities occurring in practice. When the desired adjustment has been found (possibly facilitated by the catch fixing mechanism 8, 15) the pin 28 is inserted into the bores of the fixing part 1 and of the case.

I claim:

1. A system for supporting a roller blind having a rotation axis passing through a projecting support pin (38) and a projecting drive pin (39), on room structure such as a wall, ceiling or the like, comprising:

first and second substantially identical fixture parts (1) for attachment to the room structure in opposed, spaced apart relation before the roller blind is installed, each fixture part having a fixed collar (9) projecting toward the fixed collar of the other fixture part so as to be coaxially centered about the axis after said attachment, each collar having a passage aperture (10) extending radially therethrough;

a first bearing part (2) rotatably disposed on the first fixture part and including means for selectively securing the bearing part in a particular rotational position so as to prevent accidental rotation, the bearing part further including a fixed bearing shell (13) in coaxial, overlapped relation to the collar for rotatably receiving the support pin (38), the bearing part further having an insertion aperture (14) which extends radially through the shell, whereby when the bearing part is in a rotationally open position relative to the collar such that the insertion aperture (14) is aligned with the passage aperture (10) in the collar, the support pin (38) can be displaced radially along the insertion aperture between an initial position outside the bearing part to a final position on the axis in the shell; and when the bearing part (2) is selectively rotated to said particular position, the passage aperture is closed and the pin (38) is trapped on the axis within the shell (13) and collar; and a second bearing part disposed on the second fixture part and including drive pin support means (24,25) for non-rotatably engaging the drive pin (39), and drive means (17-23) including a drag spring (17) for selectively rotating the drive pin support means, said drag spring being positioned coaxially around the collar (9) of the second fixture part.

2. A roller blind support system as claimed in claim 1, wherein said means for securing includes a friction fixing means between said bearing part (2) and said first fixture part.

3. A roller blind support system as claimed in claim 1, wherein said means for securing includes a fixing mechanism (8,15) having discrete catch positions between the bearing part (2) and the first fixture part.

4. A roller blind support system as claimed in claim 1, wherein the first and second bearing parts (2,21) have a case (12,21) with a projecting edge element which grips tightly over a shoulder (5) and into a recess (7) formed on the fixture part (1), and wherein at least one of the edge element and recess is annular in shape.

5. A roller blind support system as claimed in claim 1, wherein the drive pin support means has a coupling bore (25) of predetermined cross-sectional shape for non-rotatable accommodation of the drive pin, and wherein the coupling bore (25) is formed in an interchangeable adapter (24) which is non-rotatably connectable to the drive means (20).

6. A roller blind support system as claimed in claim 1, wherein the second fixture part (1) has a locking projection (28) and the second bearing part (21) contains recesses (29) for the accommodation of the locking projection.

7. A roller blind support system as claimed in claim 4, wherein the drive pin support means has a coupling bore (25) of predetermined cross-sectional shape for non-rotatable accommodation of the drive pin, and wherein the coupling bore (25) is formed in an interchangeable adapter (24) which is non-rotatably connectable to the drive means (20).

8. A roller blind support system as claimed in claim 4, wherein the second fixture part (1) has a locking projection (28) and the second bearing part (21) contains recesses (29) for the accommodation of the locking projection.

9. A roller blind support system as claimed in claim 5, wherein the second fixture part (1) has a locking projection (28) and the second bearing part (21) contains recesses (29) for the accommodation of the locking projection.

10. A roller blind support system as claimed in claim 1, wherein the first and second fixture parts each has a generally disk-shaped arm portion (4) and the collar (9) projects centrally from the arm portion.

11. A roller blind support as claimed in claim 10, wherein the collar and the shell are substantially cylindrical.

12. A roller blind support as claimed in claim 1, wherein the first bearing part is generally cup-shaped and the shell is a substantially cylindrical projection within the cup.

* * * * *